United States Patent [19]

Marsh

[11] Patent Number: 4,724,643

[45] Date of Patent: Feb. 16, 1988

[54] RETAINER CLIP WITH RESILIENT PAD

[75] Inventor: Thomas R. Marsh, Winston-Salem, N.C.

[73] Assignee: Tenn-Tex Plastics, Inc., Kernersville, N.C.

[21] Appl. No.: 891,400

[22] Filed: Jul. 29, 1986

[51] Int. Cl.[4] ..... E04B 1/38

[52] U.S. Cl. ..... 52/509; 403/406.1

[58] Field of Search ..... 52/208, 509, 476, 489, 52/768, 512, 202; 312/140, 224; 248/488, 466; 24/290, 297; 40/156, 157; 411/337; 403/405.1, 406.1, 407.1; 292/DIG. 20

[56] References Cited

U.S. PATENT DOCUMENTS

| | | | |
|---|---|---|---|
| 549,337 | 11/1895 | Stagg, Jr. . | |
| 771,535 | 10/1904 | Coffin . | |
| 1,856,923 | 5/1932 | Miller . | |
| 2,163,566 | 6/1939 | Blessin | 52/208 |
| 2,733,492 | 2/1956 | Copell . | |
| 2,798,327 | 7/1957 | Dibb . | |
| 2,951,668 | 9/1960 | Peterka . | |
| 2,987,811 | 6/1961 | Acres | 411/337 X |
| 3,049,323 | 8/1962 | Peterka . | |
| 3,146,502 | 9/1964 | Reiss, Sr., et al. . | |
| 3,379,402 | 4/1968 | Trammell, Jr. | 248/488 |
| 3,694,984 | 10/1972 | Schwartz . | |
| 3,769,730 | 11/1973 | Dole . | |
| 4,169,617 | 10/1979 | Koeneman et al. . | |
| 4,611,850 | 9/1986 | Fujikawa | 52/208 X |

FOREIGN PATENT DOCUMENTS 437777 7/1948 Italy .

OTHER PUBLICATIONS

Four Photographs of a Prior Art Retainer Clip.
A Photocopy of the Prior Art Retainer Clip Shown in Exhibit 1.

*Primary Examiner*—Carl D. Friedman
*Attorney, Agent, or Firm*—Bell, Seltzer, Park & Gibson

[57] ABSTRACT

A retainer clip for fastening a fragile panel into a surrounding frame comprises an integral body member which is composed of a relatively rigid material and a cushioning pad which is composed of a relatively soft material. Means are provided for mounting the cushioning pad on the body member. The cushioning pad contacts the edge portion of the panel when the body member is secured to the surrounding frame.

8 Claims, 11 Drawing Figures

RETAINER CLIP WITH RESILIENT PAD

FIELD OF THE INVENTION

The present invention relates to retainer clips for securing glass panels into furniture. More specifically, the present invention relates to an improved clip which has a relatively soft pad for reducing the chance that the glass panel will break when the assembled piece of furniture is shipped.

BACKGROUND OF THE INVENTION

Glass panels are mounted in a variety of different types of furniture, such as china cabinets and the like. To mount a glass panel in such a structure, a rigid frame which surrounds the panel is usually provided. The frame has a back face with an edge portion and a supporting ledge recessed from the edge portion. The peripheral edge portion of the glass panel rests on the supporting ledge of the frame. To secure the glass panel in place, retainer clips are fastened to the back face of the frame to hold the peripheral edge portion of the panel against the supporting ledge. One such retainer clip of the prior art is shown in U.S. Pat. No. 3,146,502 to Reiss et al.

The principal problem with these prior types of retainer clips is that a significant number of glass panels are broken while the assembled furniture is being shipped. This problem can be alleviated by using a pliable gasket to secure the glass panel in place instead of retainer clips, but such gaskets are more expensive than retainer clips. Accordingly, an object of the present invention is to provide a retainer clip which, when installed, reduces the frequency of glass panel breakage during the shipping of assembled furniture.

Another object of this invention is to provide a retainer clip which will hold the glass panel firmly in the frame, without rattling, when the piece of furniture is in use.

Other objects of the invention are to provide such a clip which can be economically made, easily assembled, and conveniently installed.

SUMMARY OF THE INVENTION

The above and other objects and advantages of the present invention are achieved in the emodiments illustrated herein by the provision of a retainer clip which comprises an integral body member, which is composed of a relatively rigid material, and which defines an outwardly facing surface and an opposite inwardly facing surface. The inwardly facing surface includes a generally planar first surface portion adapted to overlie the edge portion of the frame, and a generally planar second surface portion adapted to overlie the adjacent edge portion of the fragile panel. An opening is provided which extends transversely through the body member and communicates with said first surface portion. The opening is adapted to receive a fastening member therethrough to thereby mount the body member to the edge portion of a frame, with the first surface portion engaging the edge portion of the frame.

A cushioning pad is also provided, which is composed of a relatively soft material, and which defines a generally planar contact surface and a generally planar rear surface which faces oppositely from said contact surface. Means are provided for mounting the cushioning pad on the second surface portion of the body member, such that the contact surface of the pad is parallel to the first surface portion of the body member, and such that the contact surface of the pad is adapted to directly contact the edge portion of the fragile panel when the body member is mounted to the edge portion of the frame. The contact surface of said cushioning pad preferably lies beyond said first surface portion of said body member in the inward direction.

The means mounting the cushioning pad on the second surface portion preferably comprises a receptacle formed in the second surface portion of the body member and a mating projecting tab which is adapted to be closely received in said receptacle and which is formed on the rear surface of said cushioning pad.

BRIEF DESCRIPTION OF THE DRAWINGS

The foregoing and other objects, features and advantages of the invention will be apparent from the following description of the preferred embodiments and the drawings, in which.

DETAILED DESCRIPTION OF THE PREFERRED EMBODIMENT

Figure 1:
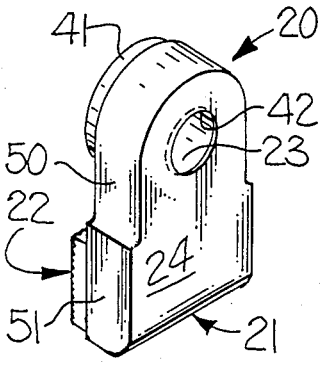
FIG. 1 is a perspective view of a retainer clip of the present invention.
Figure 6:
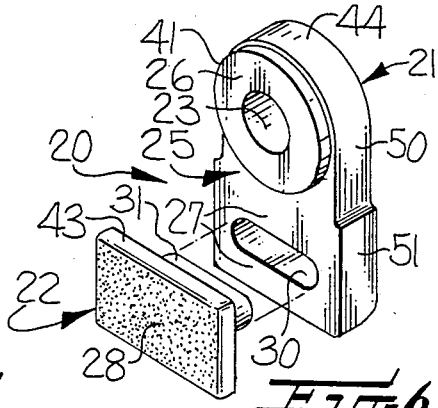
FIG. 6 is an exploded view of a retainer clip of the present invention.
Figure 8:
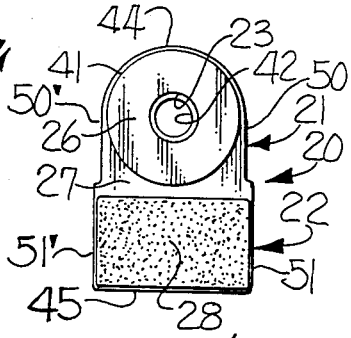
FIG. 8 is a back plan view of the present invention.
Figure 9:
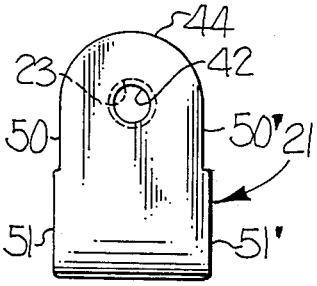
FIG. 9 is a front plan view of the present invention.

A retainer clip which is a preferred embodiment of the present invention is depicted at 20 in FIG. 1 (see also FIGS. 8 and 9). The clip has an integral body member 21, a cushioning pad 22, and an opening 23. The integral body member has an outwardly facing surface 24 and an opposite inwardly facing surface 25 (see FIG. 6). The inwardly facing surface 25, as seen in FIG. 6, includes a generally planar first surface portion 26, and a generally planar second surface portion 27. The outwardly facing surface 24 of said body member is generally planar and parallel to said first and second surface portions (26, 27) and said first and second surface portions (26, 27) are, therefore, generally parallel to each other. The opening 23 extends transversely through said body member 21 and communicates with said first surface portion 26.

Figure 5:
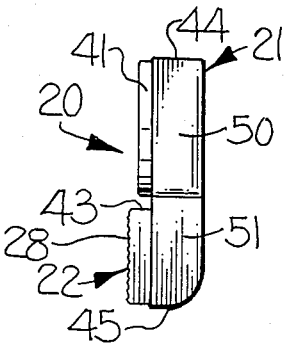
FIG. 5 is a side plan view of a retainer clip of the present invention.

The retainer clip is further comprised of a cushioning pad 22, which is shown separated from body member 21 in FIG. 6. The cushioning pad has a generally planar contact surface 28. When the cushioning pad is mounted on the second surface portion 27 of the body member, the contact surface is parallel to the first surface portion of the body member (see FIG. 5). FIG. 5 also reveals that said contact surface of said cushioning pad lies beyond said first surface in the inward direction.

Figure 4:
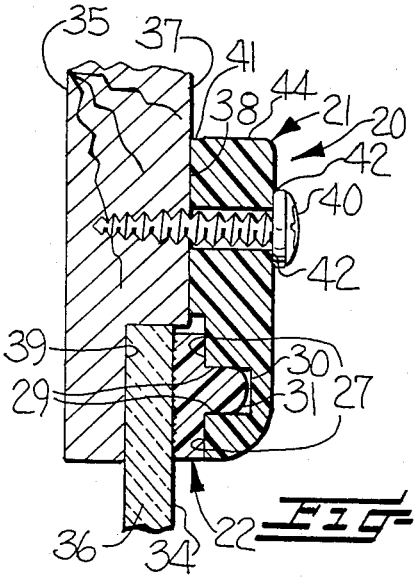
FIG. 4 is a side cutaway view of a retainer clip of the present invention installed on a frame, taken along line 4—4 of FIG. 3.

As seen in FIG. 4, the cushioning pad 22 has a generally planar rear surface 29 which faces oppositely from said contact surface 28. FIG. 6 shows that body member 21 has a receptacle 30 which is an elongate slot formed in the second surface portion 27, and that cushioning pad 22 has a mating projecting tab 31 which has a conforming elongate lateral dimension formed on said rear surface 29. The mating projecting tab 31 is adapted to be closely received in said receptacle 30. It will be appreciated that the receptacle may alternatively be formed in the cushioning pad, and the projecting tab may alternatively be formed on the second surface portion of the body member.

Figure 2:
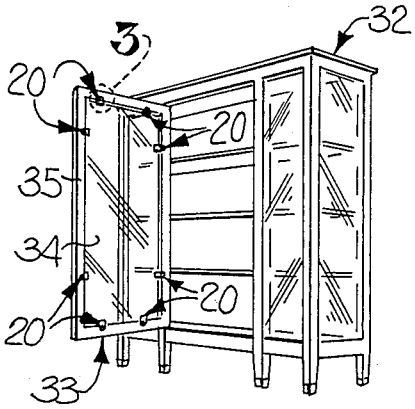
FIG. 2 is a perspective view of a cabinet having a framed glass structure of the present invention.
Figure 3:
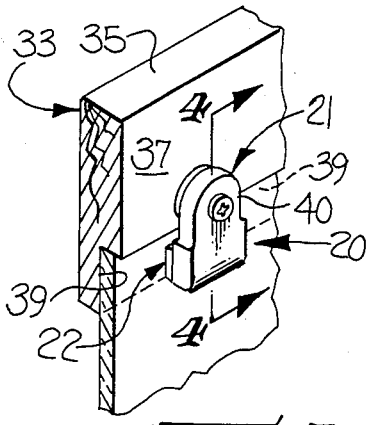
FIG. 3 is a detailed view of that portion of FIG. 2 within the circle 3.

FIG. 2 illustrates a china cabinet 32 which has a framed glass structure 33 as a door. The framed glass structure is comprised of a glass panel 34, a frame 35 surrounding the glass panel, and a plurality of retainer clips 20. Further details of this framed glass structure are visible in FIG. 3, which is an enlarged view of the area identified by circle 3 in FIG. 2. FIG. 3 shows that the glass panel 34 has edge portions 36 adjacent frame 35, and that the rigid frame 35 has a back face 37, an edge portion 38, and a recessed ledge 39. FIG. 3 also shows that the generally planar first surface portion 26 of the body member (concealed in this view) is adapted to overlie and be connected to the edge portion 38 of the surrounding frame, and that the generally planar second surface portion 27 of the molded body (also concealed in this view) is adapted to overlie the adjacent edge portion 36 of the glass panel. The adjacent edge portion of the glass panel is itself supported by the recessed ledge 39 of the surrounding frame. These aspects of the invention are also illustrated in FIG. 4, which is a cutaway view, taken along line 4—4 of FIG. 3, of a retainer clip 20 installed on a surrounding frame 35 to secure a glass panel 34 in place. FIGS. 3 and 4 also reveal that the retainer clip is secured to the edge portion 38 of the rigid frame 35 by means of a screw 40 disposed in opening 23.

Figure 7:
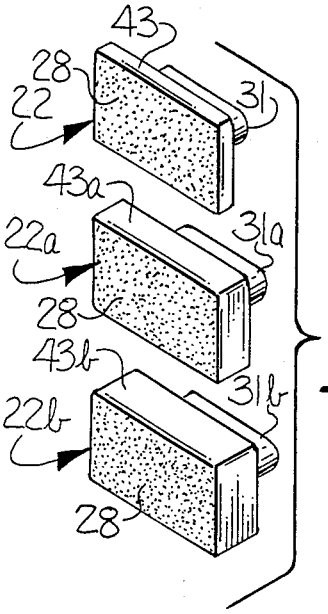
FIG. 7 illustrates alternate resilient inserts for use with retainer clips of the present invention.

FIG. 5 shows that the body member has a spacing member 41 integrally formed thereon. It can also be seen that cushioning pad 22 has a thickness, when mounted on said body member, not less than the thickness of spacing member 41. The actual difference in thickness between cushioning pad 22 and spacing member 41 will depend on the thickness of glass panel 34, and on the distance which supporting ledge 39 is recessed from the edge portion 38 of rigid frame 35. Because furniture manufacturers typically use a variety of rigid frames, with their supporting ledges recessed a variety of different predetermined distances from the back face of the frame, to construct the various different pieces of furniture they sell, a variety of different cushioning pads 22 can be made, for use with a single body member. A selection of such different cushioning pads is depicted at 22, 22*a* and 22*b* in FIG. 7, with each cushioning pad having a different predetermined thickness corresponding to a different supporting ledge recess distance.

Figure 11:
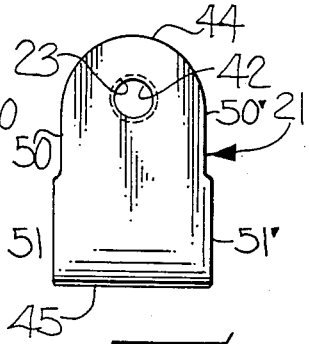
FIG. 11 is a front plan view of the alternate embodiment shown in FIG. 10.

FIGS. 1, 9 and 11, taken in conjunction with FIG. 4, also illustrate that the inner wall of opening 23 has a small integral lip 42 in the shape of a circle formed thereon adjacent the outwardly facing surface 24 of the rigid body. This lip engages the threads of the screw 40 when the screw is disposed in the hole, and rotatably secures the screw in place. When the retainer clip 20 is being installed on a frame, this feature allows the rigid body of the clip to serve as a holder and guide for the screw 40. It is therefore unnecessary to provide a pilot hole in the frame prior to fastening the clip thereto.

Figure 10:
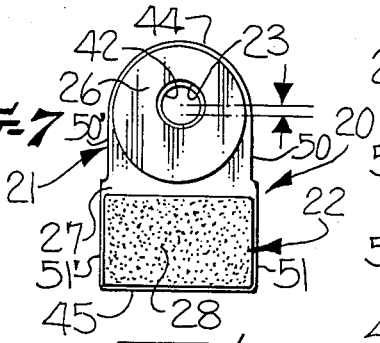
FIG. 10 is a back plan view of an alternate embodiment of the invention.

FIGS. 10 and 11 illustrate an improved version of the present invention particularly suitable for use in fastening the retainer clip 20 to a surrounding frame 35 which is constructed of wood. In this improved embodiment, opening 23 is offset in said annular spacing member, with the distance between the center of opening 23 and the top edge 43 of resilient pad 22 (best shown in FIG. 10) being at least about 0.28 inches, and preferably about 0.292 inches, to provide the desired reduction in the splitting of wood frame 35 when the screw 40 is driven into the frame. More particularly, FIG. 10 shows that body member 21 defines two longitudinally spaced apart opposite ends 44, 45, with end 44 being adjacent the first surface portion 26 of the body member, and end 45 being adjacent the second surface portion 27 (see FIG. 6) of the body member. End 44 is of an arcuate configuration in cross-section, as seen in FIG. 10, so as to define a center axis extending between said outwardly and inwardly facing surfaces. In this improved embodiment, opening 23 is offset in the longitudinal direction from said center axis, and away from said cushioning pad, to provide the distance relation specified above.

The rigid body 21 is made from any suitable relatively rigid material, and is preferably made by injection molding. One suitable material for injection molding is 10–20% fiberglass filled polyethylene. The cushioning pad 22 is formed from any suitable relatively soft material, is also preferably made by injection molding, and is preferably colored to be substantially the same color as the rigid body 21 so that the assembled clip 20 will be of a single color and have a continuous unitary appearance, as if made from a single molded part, which will be visually attractive when the clip is mounted on a piece of furniture. The material from which the resilient insert is formed should be selected to have a durometer reading on the Shore A scale, 10 sec. of from not less than about 40 to not more than about 100, as determined by ASTM #D-2240, and should preferably be selected to have a durometer reading of from about 65 to about 85. A specific material suitable for use in making the resilient insert is ALPHA 3006 PVC, sold by Alpha Chemicals and Plastics of Newark, N.J. This material has a durometer reading of 85 (±3).

In the drawings and specification, there has been disclosed typical preferred embodiments of the invention. Although specific terms are employed, they are used in a generic and descriptive sense only and not for purposes of limitation, the scope of the invention being set forth in the following claims.

That which is claimed is:

1. A retainer clip for securing a fragile panel within a surrounding frame and comprising an integral body member composed of relatively rigid material and defining an outwardly facing surface and an opposite inwardly facing surface, said inwardly facing surface including a generally planar first surface portion adapted to overlie the edge portion of the frame and a generally planar second surface portion adapted to overlie the adjacent edge portion of the fragile panel, said body member also defining longitudinally spaced apart opposite ends, with one of said ends being adjacent said first surface portion and the other of said ends being adjacent said second surface portion, said one end adjacent said first surface portion being of arcuate configuration in cross-section so as to define a center axis extending between said outwardly and inwardly facing surfaces, an opening extending transversely through said body member and communicating with said first surface portion and adapted to receive a fastening member therethrough to thereby mount said body member to the edge portion of the frame with said first surface portion engaging the edge portion of the frame, said opening defining an axis which is parallel to said center axis and offset from said center axis in the longitudinal direction toward said one end of said body member, a cushioning pad composed of a relatively soft material and defining a generally planar contact surface, means mounting said cushioning pad on said second surface portion of said body member such that said contact surface of said pad is parallel to said first surface portion of said body member, and such that said contact surface of said pad is adapted to directly contact the edge portion of the fragile panel when said body member is mounted to the edge portion of the frame, and whereby the offset of said opening with respect to said center axis serves to separate the fastening member from the edge of the frame to thereby reduce splitting of the frame by the threaded fastener.

2. The retainer clip as defined in claim 1 wherein said cushioning pad further defines a generally planar rear surface which faces oppositely from said contact surface, and wherein said means mounting said cushioning pad on said second surface portion comprises a receptacle formed in one of either of said second surface portion of said body member or said rear surface of said cushioning pad, and a mating projecting tab which is adapted to be closely received in said receptacle and which is formed on the other of said second surface portion of said body member or said rear surface of said cushioning pad.

3. The retainer clip as defined in claim 2 wherein said contact surface of said cushioning pad lies beyond said first surface portion of said body member in the inward direction.

4. The retainer clip as defined in claim 2 wherein said first and second surface portions of said body member are generally parallel to each other.

5. The retainer clip as defined in claim 4 wherein said outwardly facing surface of said body member is generally planar and parallel to said first and second surface portions.

6. The retainer clip as defined in claim 1 wherein said opening includes means formed therein for rotatably securing a threaded fastener therein.

7. The retainer clip as defined in claim 1 wherein said body member and said cushioning pad are each formed of molded plastic.

8. A retainer clip as claimed in claim 2 wherein said receptacle and said projecting tab each have an elongate lateral dimension.

* * * * *